US005445082A

United States Patent [19]

Lenk

[11] Patent Number: 5,445,082

[45] Date of Patent: Aug. 29, 1995

[54] GANTRY BOGIE FOR CONNECTION BETWEEN SUCCESSIVE CARRIAGES OF RAILBORNE VEHICLES

[75] Inventor: Leopold Lenk, Vienna, Austria

[73] Assignee: SGP Verkehrstechnik Gesellschaft m.b.H., Vienna, Austria

[21] Appl. No.: 161,302

[22] Filed: Dec. 2, 1993

[51] Int. Cl.[6] ..... B61D 17/20

[52] U.S. Cl. ..... 105/4.1; 105/8.1; 105/180; 105/218.1

[58] Field of Search ..... 105/4.1, 8.1, 169, 180, 105/199.5, 218.1, 224.05, 224.1; 280/403, 443

[56] References Cited

U.S. PATENT DOCUMENTS

| | | | |
|---|---|---|---|
| 2,356,962 | 8/1944 | Williams | 105/169 |
| 2,941,482 | 6/1960 | Furrer | 105/169 |
| 3,678,863 | 7/1972 | Pringle | 105/4.1 |
| 4,135,456 | 1/1979 | Welsh | 105/199.5 X |
| 4,166,611 | 9/1979 | Geers et al. | 105/218.1 X |
| 4,776,283 | 10/1988 | Shozi et al. | 105/224.1 |
| 4,867,071 | 9/1989 | Weber | 105/4.1 |
| 4,986,190 | 1/1991 | Harsy | 105/4.4 |

FOREIGN PATENT DOCUMENTS

| | | |
|---|---|---|
| 541049 | 9/1955 | Belgium . |
| 0349817 | 1/1990 | European Pat. Off. . |
| 0443309 | 8/1991 | European Pat. Off. . |
| 804812 | 4/1951 | Germany . |
| 1294412 | 5/1969 | Germany . |
| 8705873 | 10/1987 | WIPO . |

*Primary Examiner*—Robert J. Oberleitner
*Assistant Examiner*—S. Joseph Morano
*Attorney, Agent, or Firm*—Jacobson, Price, Holman & Stern

[57] ABSTRACT

Gantry bogey 19 for railborne vehicles inserted between adjoining ends of successive carriages 20, 21 of a carriage consist and forming at least in part the passage between the two carriages 20, 21 and comprising transversely to the direction of travel mutually opposing wheels 28 which are bridged by a gantry 29 which on both sides by way of vertical pillars 2 is supported on the respective wheel case 27 holding the wheel. The vertical pillars 2 are constructed at least in the lower region as tubes which are each guided by a pin 2 carried by the wheel case 27 by way of a spring.

14 Claims, 3 Drawing Sheets

GANTRY BOGIE FOR CONNECTION BETWEEN SUCCESSIVE CARRIAGES OF RAILBORNE VEHICLES

BACKGROUND OF THE INVENTION AND PRIOR ART

The invention relates to a gantry bogey for railborne vehicles inserted between adjoining ends of successive carriages of a carriage consist and forming at least in part the passage between the two carriages and comprising transversely to the direction of travel mutually opposing wheels which are bridged by a gantry which on both sides by way of vertical pillars are supported on the respective wheel case holding the wheel.

A gantry bogey of this type forms the subject of EP-A2-0 349 817.

OBJECTS AND GENERAL DESCRIPTION OF THE INVENTION

An object of the invention is the provision of a combination of the spring means of a gantry bogey in which the gantry determines the spacing of a wheels and the pin transmits the guidance of the wheels to the gantry and is carried by way of the spring means.

The present invention provides a gantry bogey as set out in the introductory paragraph, wherein the vertical pillars are constructed at least in the lower region as tubes which are each guided by a pin carried by the wheel case by way of a spring. Preferably the spring is composed of at least two rubber blocks one above the other, between which preferably a spacer disc is provided. More particularly the pin guiding the pillar passes through the top wall of a wheel case holding the wheel or a wheel frame and is firmly clamped in a cup fixed to the underside of the top wall, the pin at its lower end being provided with a threaded bolt passing through the bottom of the cup and onto which a shaft nut is screwed, which is secured by a locking plate.

Preferably between the rubber blocks and the top wall of the wheel casing, respectively, a spacer is provided which preferably is seated in a rebate of the top wall.

According to a preferred feature, between the pillar and pin at least one silencing block is provided which is composed of plastics or metal and comprises an inner sleeve of rubber or the like. Also preferably, each pillar at its lower end is closed by a plate which is secured to the pillar preferably by a transverse bolt. Advantageously between the silencing block and the pin a spacer sleeve is provided which on its inside preferably carries a steel sleeve.

In the preferred embodiment for securing the pillar to the pin when lifting the gantry a hook is provided which clips over a bracket or the like laterally projecting from the pillar.

BRIEF DESCRIPTION OF THE DRAWINGS

The invention will be further explained with reference to the drawings in which a working example of the gantry including the spring means is illustrated.

There is shown in

DETAILED DESCRIPTION OF SPECIFIC EMBODIMENTS

Figure 1:
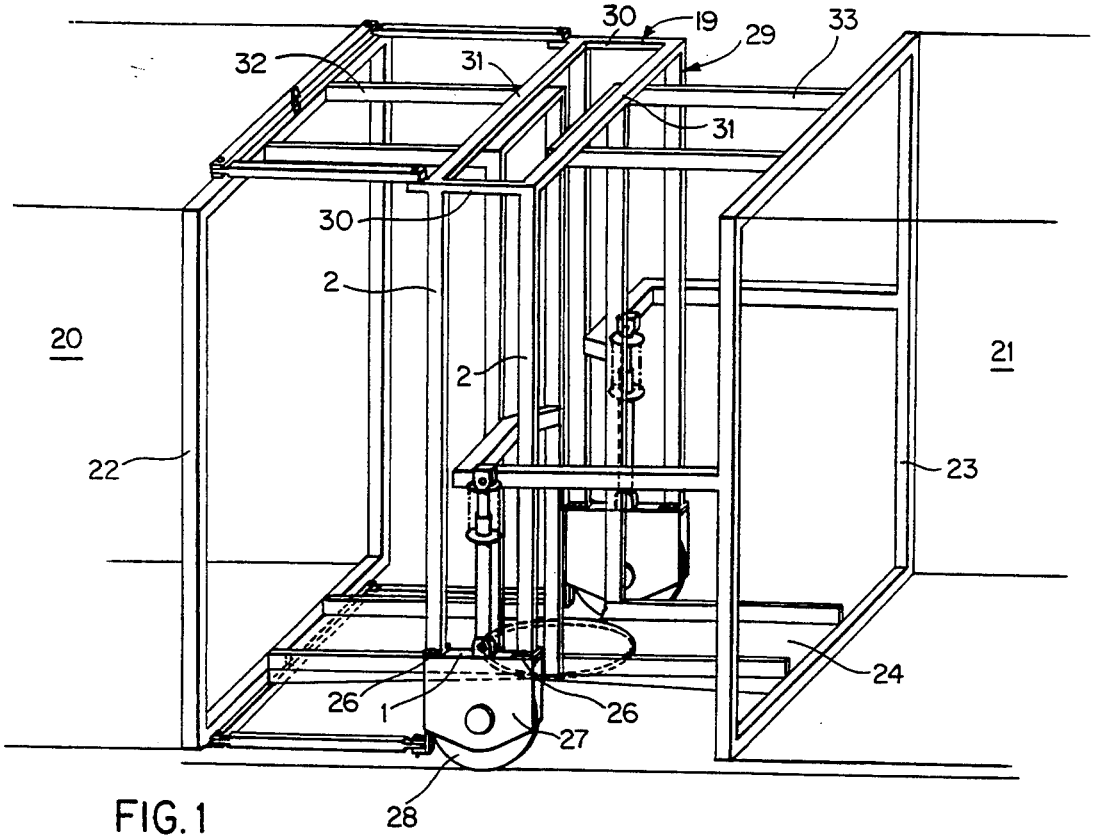
FIG. 1 a working example of a gantry bogey.

The gantry bogey 19 illustrated in FIG. 1 is located between two successive carriages 20, 21, the ends of which are indicated by the frames 22 and 23.

The space between the two carriages is designed as a through-passage, the floor of which is denoted as 24. At least part of this passage is formed by the gantry bogey 19 which on both sides of the floor 24 comprises one pair each of vertical pillars 2 which at their bottom ends are each supported by way of a spring 26 against the top wall 1 of a wheel case 27 in which a single wheel 28 is mounted.

The pillars 2 are connected at their upper end in the direction of travel by beams 30 and in the transverse direction by beams 31 and thus form a gantry 29 which embraces the frames 32, 33 projecting towards one another from the frames 22, 23.

Figure 2:
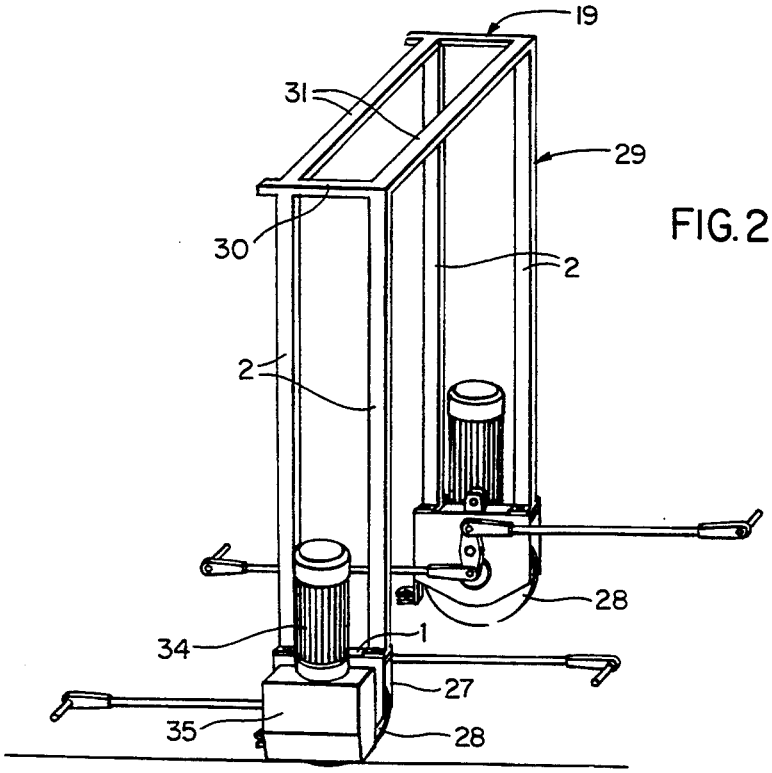
FIG. 2 the gantry with driven loose wheels.

In the embodiment of the gantry bogey according to FIG. 2 the wheels 28 are each driven by a motor 34 mounted vertically on a gearbox 35 fitted to the wheel case 27.

Figure 3:
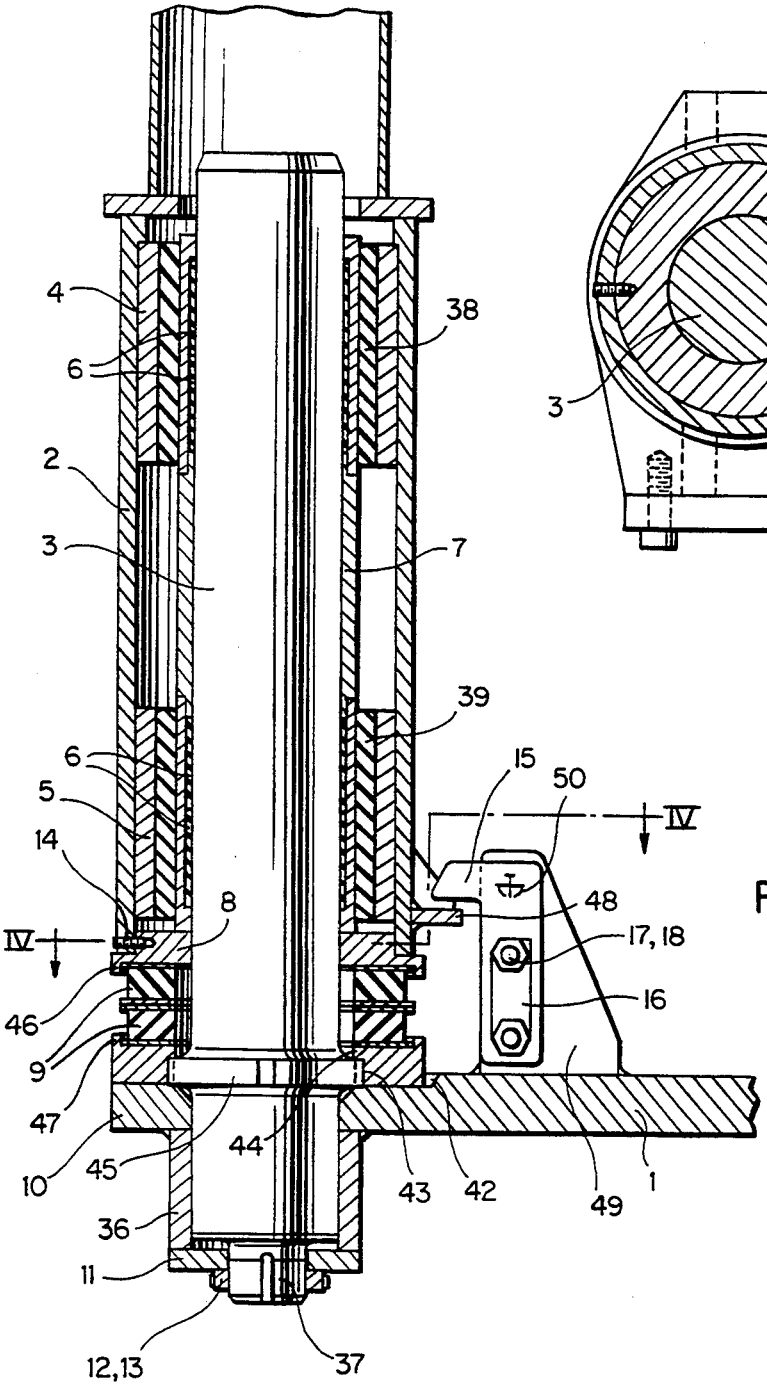
FIG. 3 the lower portion of the vertical pillars including their spring support against the bogey FIG. 4 a section along the line IV—IV of FIG. 3, FIG. 5 a side elevation of the an alternate embodiment of antry, and FIG. 6 an end elevation thereof.
Figure 4:
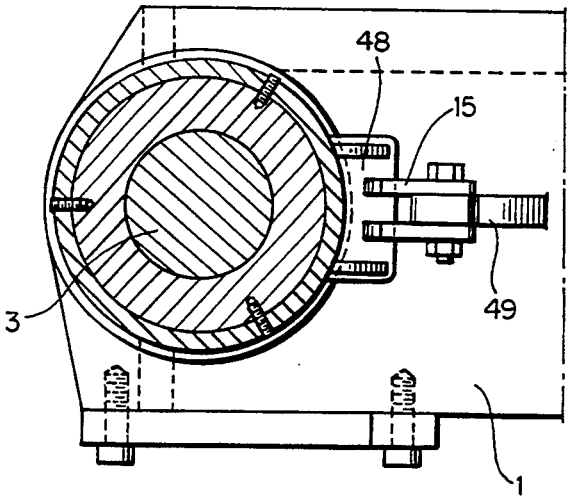
Figure 6:
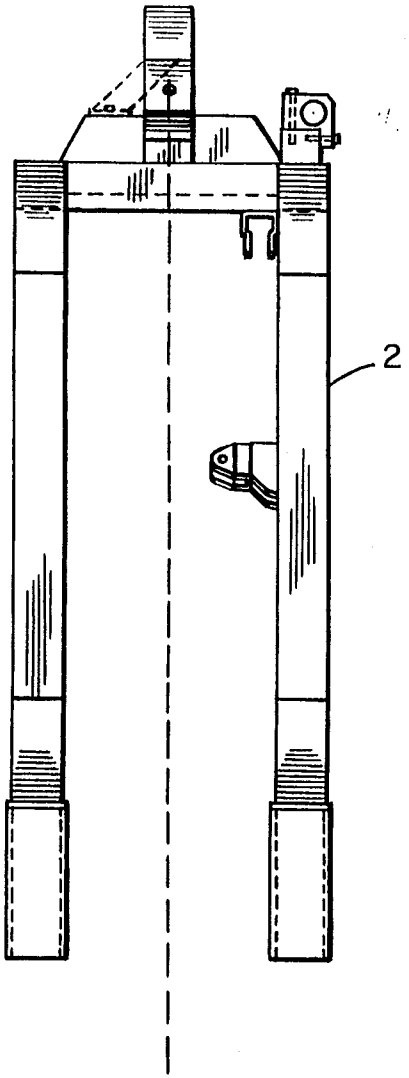

The pillars 2, at least in their lower region as shown in FIG. 3 and 4, take the form of tubes guided on a vertical pin 3 which passes through the top wall 1 of the wheel case 27 and is firmly pressfitted into a cup 36 fitted to the bottom of the top wall 1. The pin 3, in order to be secured, is provided at its lower end with a threaded bolt 37 passing through the bottom 11 of the cup 36 and has a shaft nut 13 screwed onto it secured by a locking plate 12. Each of the pins 3 is enclosed by a spacer bush 7, between which and the pillar 2 two spaced apart silencer blocks 38 and 39 are provided of which each comprises an outer sleeve 4 and 5, respectively preferably made of metal or plastics and an inner rubber sleeve 6.

The pillars 2 are each closed at their bottom end by a plate 8 fixed in place by transverse bolts 14. The plate 8 is seated by way of two rubber blocks 9 on a spacer disc 10 which is seated on the top wall 1 in a rebate 42 thereof. The spacer disc 10 is provided on its inside with a rebate 43 whereby a projecting flange 44 is formed by means of which the spacer disc 10 overlaps a beading 45 of the pin 3 from above. The plate 8 and the spacer disc form mutually opposing collars 46, 47 on the rim side for securing the rubber blocks 9. It stands to reason that within the scope of the invention the number and configuration as well as the material for the rubber block 9 can be selected optionally.

In order to secure the above described construction according to FIGS. 3 and 4 when lifting the gantry 29, a hook 15 is provided which grips over a bracket 48 fixed to the pillar 2. The hook 15 is fixed by two screws 17, 18, one above the other to a bracket 49 firmly connected to the top wall 1. The screws 17, 18 are arranged at the end of a vertical slot 16 of the hook 15 and pass though matching holes of the bracket 49. In addition to the holes for the screws 17, 18 the bracket 49 comprises an additional hole 50 aligned with the afore-said holes and provided there above as indicated in FIG. 3 in broken lines. The hole 50 is arranged at a distance from the hole intended for the screw 17, equal to the distance between the holes for the screws 17 and 18 so that after removing the screw 18 the hook 15 can be lifted until the screw 17 has reached the lower end of the slot 16 whereupon the screw 18 is screwed into the hole 50. In this manner it is possible to adjust the level of the gantry 29 higher or lower by the distance of the holes, for which purpose it is also possible to provide more than three holes to make a stepwise adjustment possible. If the gantry is adjusted to a higher level, appropriate washers are inserted between the plate 8 and the rubber blocks 9 there underneath.

The gantry 29 and the pin 3 form a vertical guide in which the pin 3 performs the task of transmitting the guidance of the wheel to the gantry in the vertical axis so that the spring is movably mounted between the gantry and the wheel case. This movable mounting corresponds to a primary spring.

Figure 5:
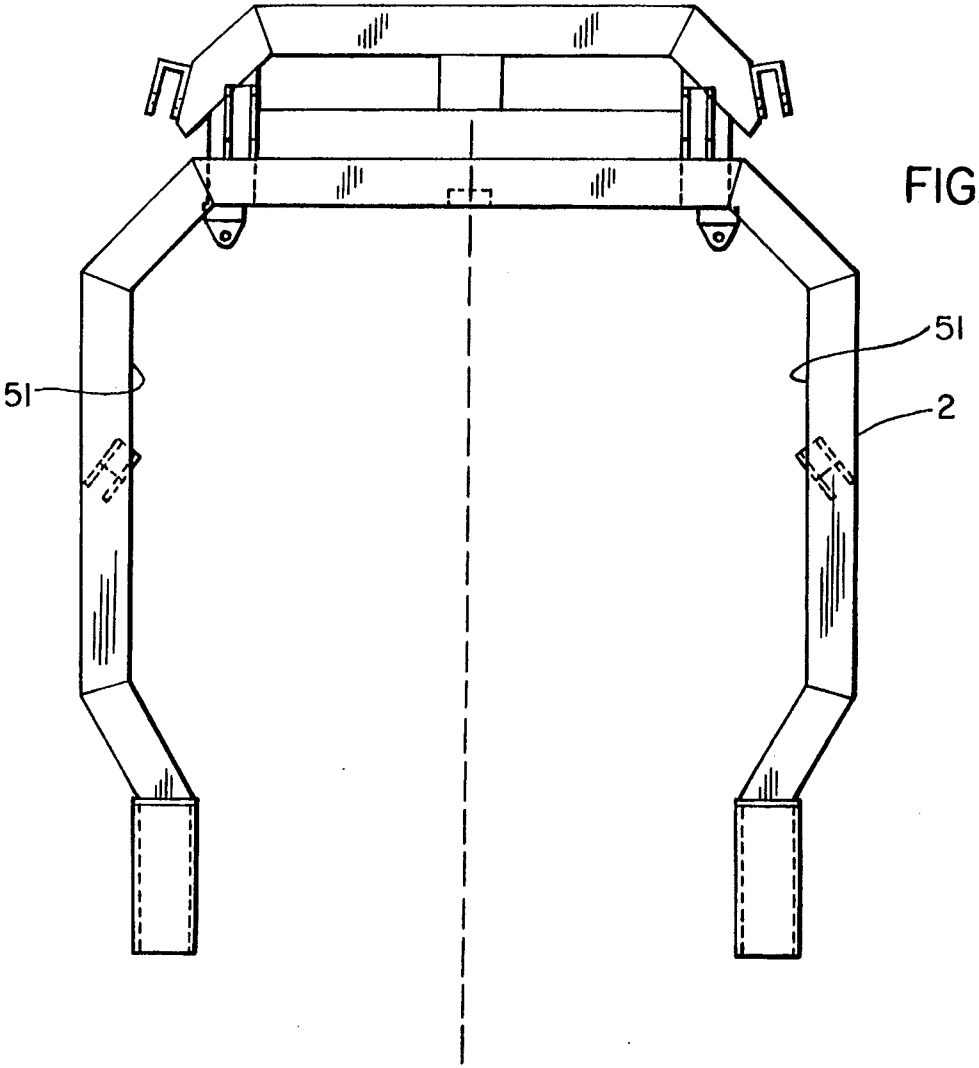

As shown in FIG. 5, the pillars 2, transversely to the direction of travel, comprise a laterally outwardly extending corner moulding 51.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. Gantry bogey for railborne vehicles inserted between adjoining ends of successive carriages and forming at least in part a passage between the carriages and comprising transversely to the direction of travel mutually opposing at least two loose wheels, each on one side of the gantry bogey which are bridged by a gantry supported on both sides by vertical pillars on a respective wheel case holding the wheel, wherein the vertical pillars are constructed at least in the lower region as tubes each guided by a pin transmitting the guidance of the wheel to the gantry in the vertical axis and carried by the wheel case by a primary spring, the tubes being guided on said pins by means of at least two spaced sleeve members.

2. Gantry bogey according to claim 1, wherein the spring is composed of at least two rubber blocks one above the other.

3. Gantry bogey according to claim 2, wherein between the two rubber shocks a spacer disc is provided.

4. Gantry bogey according to claim 2, wherein between the rubber blocks and the top wall of the wheel case a spacer is provided.

5. Gantrey bogey according to claim 4, wherein the spacer is seated in a rebate of the top wall.

6. Gantry bogey according to claim 1, wherein the pin guiding the pillar passes through a top wall of the said wheel case and is firmly clamped in a cup fixed to the underside of the top wall, the pin at its lower end being provided with a threaded bolt passing through the bottom of the cup and onto which a shaft nut is screwed by a locking plate.

7. Gantry bogey according to claim 1, wherein said spaced sleeve members between the pillar and pin consist of silencing blocks having an inner sleeve of rubber and an outer sleeve of steel.

8. Gantry bogey according to claim 7, wherein between the silencing block and the pin a spacer sleeve is provided.

9. Gantry bogey according to claim 8, wherein the spacer sleeve on its inside carries a steel sleeve.

10. Gantry bogey according to claim 1, wherein each pillar at its lower end is closed by a plate which is secured to the pillar.

11. Gantry bogey according to claim 10, wherein the plate is secured to the pillar by a transverse bolt.

12. Gantry bogey according to claim 1, wherein for securing the pillar to the pin when lifting the gantry a hook is provided which clips over a bracket laterally projecting from the pillar.

13. Gantry bogey according to claim 12, wherein the hook is level adjustable and can be fixed in position and is held by at least two screws accommodated in a vertical slot of the hook to a bracket of the top wall the bracket comprising holes for the passage therethrough of superimposed screws and at least one additional hole for replugging the lower-most screw.

14. Gantry bogey according to claim 1, wherein the pillar in its upper portion transversely to the direction of travel has a corner moulding.

* * * * *